US008614727B2

(12) United States Patent
Hirano

(10) Patent No.: US 8,614,727 B2
(45) Date of Patent: Dec. 24, 2013

(54) IMAGE FORMING APPARATUS FOR CONTROLLING EXPOSURE INTENSITY OF A PHOTOSENSITIVE MEMBER

(75) Inventor: Masayuki Hirano, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/086,234

(22) Filed: Apr. 13, 2011

(65) Prior Publication Data

US 2011/0255891 A1 Oct. 20, 2011

(30) Foreign Application Priority Data

Apr. 16, 2010 (JP) ..... 2010-095272

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/116, 118, 229, 234–237, 246–250
See application file for complete search history.

(56) References Cited

U.S. PATENT DOCUMENTS

| | | | | |
|---|---|---|---|---|
| 5,359,434 | A | 10/1994 | Nakao | |
| 6,795,099 | B2 * | 9/2004 | Koga et al. | 347/129 |
| 8,064,810 | B2 * | 11/2011 | Okumura et al. | 399/301 |
| 2003/0156180 | A1 | 8/2003 | Koga | |
| 2009/0022504 | A1 | 1/2009 | Kuwabara | |
| 2010/0166444 | A1 * | 7/2010 | Nomura et al. | 399/51 |

FOREIGN PATENT DOCUMENTS

| | | | | | |
|---|---|---|---|---|---|
| JP | 4-265982 | A | | 9/1992 | |
| JP | 5-208523 | A | | 8/1993 | |
| JP | 10207167 | A | * | 8/1998 | G03G 15/01 |
| JP | 2004-223716 | A | | 8/2004 | |
| JP | 2007003862 | A | * | 1/2007 | G03G 15/00 |
| JP | 2009-25570 | A | | 2/2009 | |

* cited by examiner

*Primary Examiner* — Hai C Pham
(74) *Attorney, Agent, or Firm* — Canon USA Inc. IP Division

(57) ABSTRACT

A first mark and a second mark are provided on a photosensitive drum and a rotation reference position sensor detects these marks. A counter is reset according to a detection signal corresponding to the first mark, and is incremented its count value according to a detection signal corresponding to the second mark. A CPU controls an exposure intensity based on light amount correction data read from a memory according to the counted value.

8 Claims, 7 Drawing Sheets

IMAGE FORMING APPARATUS FOR CONTROLLING EXPOSURE INTENSITY OF A PHOTOSENSITIVE MEMBER

BACKGROUND OF THE INVENTION

1. Field of the Invention

The present invention relates to a technique for performing image formation processing by an electrophotographic method, such as a laser printer and a copy machine.

2. Description of the Related Art

An electrophotographic image forming apparatus, such as a copy machine and a laser beam printer, forms an image by performing the following process. First, a surface of a photosensitive member is charged by a charging apparatus. Then, an electrostatic latent image is formed on the photosensitive member by exposing the charged photosensitive member to a light beam to change an electric potential on the surface of the photosensitive member from a charge potential. The formed electrostatic latent image is developed as a toner image by a development apparatus, and the developed toner image is transferred to a recording medium such as paper. The toner image transferred on the recording medium is fixed thereon by a fixing apparatus.

It is impossible to form a photosensitive layer with a uniform thickness (hereinafter referred to as "film thickness") on a photosensitive member due to the limitation of manufacturing accuracy. Since the film thickness of the photosensitive layer affects a potential change characteristic at the time of charging and exposing the photosensitive member, a non-uniform film thickness makes it impossible for the photosensitive member to have a uniform surface potential when the photosensitive member is charged and when the photosensitive member is exposed to a light beam of a constant light amount. A non-uniform film thickness of the photosensitive member makes it impossible to achieve uniformity in the surface potential of the electrostatic latent image at positions having different film thicknesses even if the photosensitive member is charged and exposed under the same condition. A non-uniform surface potential leads to a non-uniform toner adhesion amount when the electrostatic latent image is developed, so that image density may vary at different positions even if the charging and exposure are performed under the same condition, resulting in density unevenness in an output image.

Japanese Patent Application Laid-Open No. 2004-223716 discusses a technique (shading correction) for correcting density unevenness by correcting a variation in a surface potential of a photosensitive member due to unevenness of a film thickness of the photosensitive member. An image forming apparatus discussed in Japanese Patent Application Laid-Open No. 2004-223716 includes a memory for storing light amount correction data according to the film thickness. The image forming apparatus locates a position to be exposed to a light beam on the photosensitive member during image formation, reads out the light amount correction data from the memory according to the exposure position, and controls the light amount of the light beam based on the light amount correction data.

The photosensitive member is provided with a reference mark indicating a rotation reference position thereof to locate an exposure position, and the image forming apparatus can start counting of a reference clock when the reference mark passes through a rotation reference position sensor. The image forming apparatus locates, based on the count value, an exposure position to a light beam in the rotational direction of the photosensitive member. Further, the image forming apparatus includes a synchronization sensor for adjusting an image writing start position in the rotational axial direction of the photosensitive member in a region scanned by a light beam. The image forming apparatus starts counting by another counter when the synchronization sensor outputs a synchronization signal, and locates an exposure position in the rotational axial direction based on the count value. The light amount correction data is read out from the memory according to the exposure position located based on both of the count values.

Once image data is input, the photosensitive member is controlled to be accelerated so that the rotational speed thereof reaches a predetermined rotational speed, and once the rotational speed thereof reaches the predetermined rotational speed, the photosensitive member is controlled to rotate at a constant speed. The above described image forming apparatus is set in a state ready for image formation (exposure), when the speed control is switched from the acceleration control to the constant speed control, and the rotational reference position sensor detects the reference mark (home position mark, hereinafter referred to as "HP mark").

However, the image forming apparatus discussed in Japanese Patent Application Laid-Open No. 2004-223716 includes the following problem. In a precise sense, the photosensitive member does not rotate at a constant speed. If the rotational speed is changed, the light amount correction data corresponding to the exposure position to a light beam may be unable to be read out. More specifically, for example, it is assumed that the light amount correction data corresponding to the count value "10" is read out from the memory while the photosensitive member rotates at a higher speed than a predetermined rotational speed. In this case, however, an actual exposure position would be a position corresponding to the count value "11", since the rotational speed of the photosensitive member is higher than the predetermined rotational speed. When the corresponding relationship cannot be established between the read light amount correction data and the exposure position in this way, it is impossible to execute accurate shading correction.

If an encoder is disposed at the photosensitive member for counting an output from the encoder, the light amount correction data can be read out based on the count value, and the corresponding relationship can be maintained between an exposure position and the read light amount correction data if the rotational speed of the photosensitive member is changed. However, a new encoder in addition to the rotational reference position sensor for detecting the HP mark is required, so that the manufacturing cost of the image forming apparatus will increase.

SUMMARY OF THE INVENTION

According to an aspect of the present invention, an image forming apparatus comprising: a photosensitive member configured to be driven to rotate by a drive unit, wherein the photosensitive member includes a first mark and a plurality of second marks whose shape is different from a shape of the first mark, and the first mark and the plurality of second marks are disposed along the rotational direction of the photosensitive member; an exposure unit configured to perform exposure of the photosensitive member; a detection unit configured to detect the first mark and the plurality of second marks; a storage unit configured to store correction data corresponding to the first mark and the plurality of second marks; and a control unit configured to control an exposure intensity of the exposure unit based on the correction date corresponding to the first mark and the plurality of second marks in accordance with detection of the first mark by the detection unit and a count value of detecting the plurality of second marks after detecting the first mark by the detection unit.

f

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
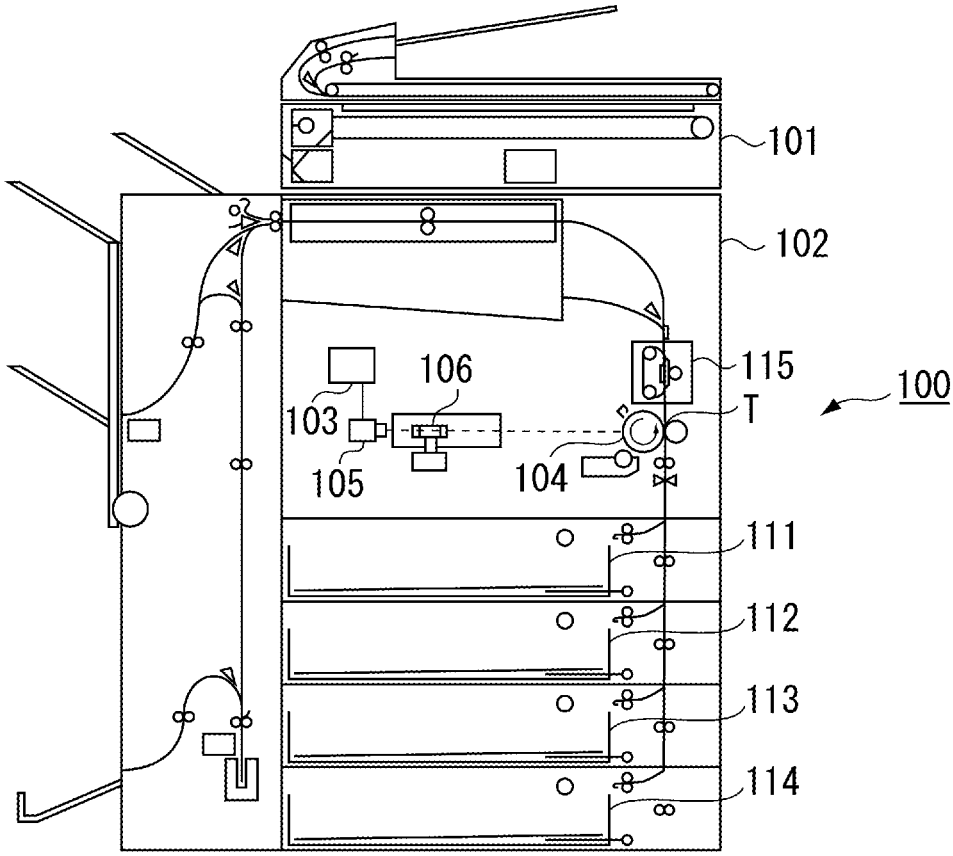
FIGS. 1A and 1B illustrate a configuration of a main body of an image forming apparatus.

FIG. 1A is a cross-sectional view illustrating a configuration of a main body of an electrophotographic image forming apparatus 100. The image forming apparatus 100 according to a first exemplary embodiment includes an image reading unit 101, and an image forming unit 102. The image reading unit 101 reads an image on an original document to generate read data. The read data is transmitted to the image forming unit 102.

The image forming unit 102 is configured in the following manner. The image forming unit 102 includes an image signal generation unit 103, which will be described below, a photosensitive drum 104 which is a photosensitive member, and a semiconductor laser 105 which is a light source for emitting a light beam (laser light) that the photosensitive drum 104 is exposed thereto. Further, the image forming unit 102 includes a rotating polygon mirror (hereinafter referred to as "polygon mirror 106") which serves as a scanning unit for deflecting the laser light so that the laser light emitted from the semiconductor laser 105 scans on the photosensitive drum 104.

Figure 1B:
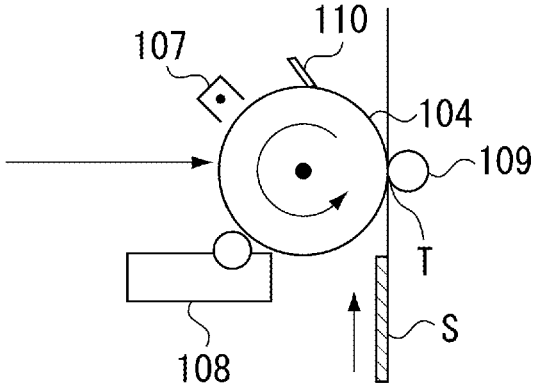

FIG. 1B is an enlarged view of the photosensitive drum 104 and the vicinity thereof. As illustrated in FIG. 1B, there are provided a charging apparatus 107 for charging the photosensitive drum 104, and a development apparatus 108 for developing, with a toner, an electrostatic latent image which is formed on the photosensitive drum 104 by being exposing to the laser light. Further, there is provided a transfer apparatus 109 for transferring a toner image formed on the photosensitive drum 104 to a recording sheet S which is a recording medium. The toner left on the photosensitive drum 104 without being transferred is removed by a cleaner 110 which scraps off the remaining toner by contacting the photosensitive drum 104.

Returning to FIG. 1A, when the read data is input to the image signal generation unit 103, the image signal generation unit 103 generates an image signal (image data) modulated by the Pulse Width Modulation (PWM) method for driving the light source which will be described below, based on the read data. The image signal generation unit 103 also receives data input from an external apparatus such as a personal computer (PC) and generates an image signal based on the input data.

Next, the image formation process performed by the image forming unit 102 will be described. First, the charging apparatus 107 charges the surface of the photosensitive drum 104 driven to rotate by a rotation drive unit which will be described below. Then, the semiconductor laser 105 emits laser light based on the image data. The laser light turns into scanning light by being deflected by the polygon mirror 106, and the scanning light is guided by a lens and a mirror (which are not illustrated) to the photosensitive drum 104 controlled to rotate at a predetermined speed. The charging potential on the photosensitive drum 104 is changed by being exposed to the laser light, and an electrostatic latent image is formed on the photosensitive drum 104. The electrostatic latent image formed on the photosensitive drum 104 is visualized by the development apparatus 108 with a developer (toner).

Sheet feeing cassettes 111, 112, 113, and 114 contain recording sheets S of different sizes, respectively, and a recording sheet S is fed from the appropriate one of the cassettes according to an instruction from a user. The recording sheet S fed from the cassette is conveyed to a transfer unit T. The toner image formed on the photosensitive drum 104 is transferred to the conveyed recording sheet S by the transfer apparatus 109 at the transfer unit T. The recording sheet S with the toner image transferred thereto is subjected to fixing processing at the fixing apparatus 115, and then is discharged to the outside of the image forming apparatus 100.

The features of the image forming apparatus 100 according to the present exemplary embodiment is described below. In a precise sense, the film thickness of the photosensitive drum 104 is not uniform due to the limitation of manufacturing accuracy, and scraping on the surface of the photosensitive drum 104 for cleaning a remaining toner. Therefore, it is impossible to achieve uniformity in the surface potential of the photosensitive drum 104 when the surface is evenly charged and exposed to light. As a result, density unevenness occurs in an output image, and a density difference is generated between an original image and the output image.

As a measure against such problem, there is known an image forming apparatus capable of controlling intensity of laser light (a light amount) according to an exposure position. However, as described above, when the rotational speed of the photosensitive drum 104 is changed, an exposure position may not be located accurately. The image forming apparatus according to the present exemplary embodiment can accurately control exposure intensity even if the rotational speed of the photosensitive drum 104 is changed.

Further, the image forming apparatus 100 according to the present exemplary embodiment can prevent an increase in first copy out time (FCOT), as will be described below.

On the other hand, the conventional image forming apparatus cannot start image formation until the next reference mark is detected, even when the speed control is switched from the acceleration control to the constant speed control immediately after the reference mark has passed through the detection position of the rotation reference position sensor.

For example, if the image forming apparatus controls a drum-shaped photosensitive member 84 mm in diameter to rotate in such a manner that the surface speed thereof is 263 mm/sec under the constant speed control, the photosensitive member finishes one rotation, taking the following time:

$$84*3.14/263 \approx 1 \text{ (sec)} \quad \text{(expression 1)}$$

This means that, if the speed control of the photosensitive drum is switched from the acceleration control to the constant speed control immediately after the reference mark has passed through the rotation reference position sensor, the output of the image is delayed for 1 second at a maximum.

In recent years, as electrophotographic printers have been increasingly sophisticated, there has been raised a demand for improvement of the ability to immediately respond to a print request. One index for evaluating the responsiveness is First Print Out Time (FPOT) or FCOT which indicates a time elapsed from an issuance of a print instruction from a user to a completion of an output of a first recording medium with an image formed thereon. It is desirable that the FPOT or FCOT are several seconds or less.

However, the conventional image forming apparatus may require a waiting time of about 1 second at a maximum as described above, which means a significant reduction in the performance for the printer which performs a shading correction.

When the rotation control of the photosensitive member is switched from the variable speed control to the constant speed control as described above, image formation cannot be started until the polygon mirror reaches a constant speed rotation state. Therefore, if the polygon mirror takes a longer time to reach the constant speed rotation state than the time taken by the photosensitive member to reach the constant speed rotation state, the above described problem is reduced or never occurs. However, since weight saving is realized in a polygon mirror used in recent image forming apparatuses, the polygon mirror can reach the constant speed rotation state in a time shorter than the time taken by the photosensitive member to reach the constant speed rotation state. Therefore, in the recent image forming apparatuses, a state ready for image formation is established when the photosensitive member reaches the constant speed rotation state.

Figure 2:
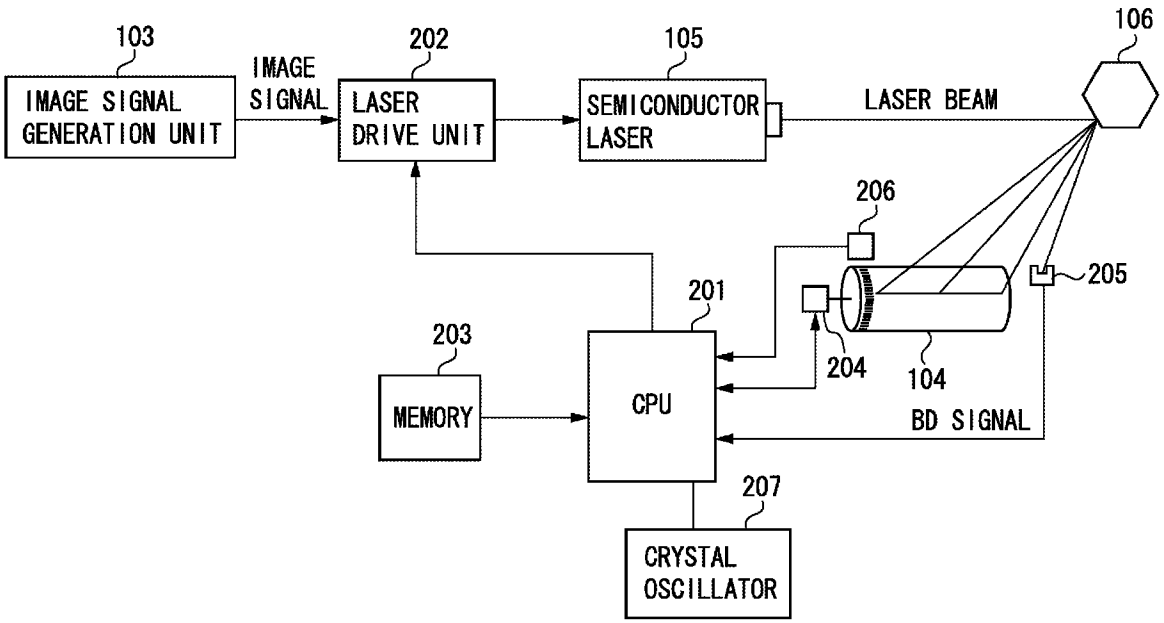
FIG. 2 is a control block diagram according to a first exemplary embodiment of the present invention.

In the following, the image forming apparatus capable of solving the above described problem will be described in further detail. FIG. 2 is a control block diagram of the image forming apparatus according to the present exemplary embodiment. Upon an input of data, the image signal generation unit 103 generates an image signal based on an instruction of a central processing unit (CPU) 201, and outputs the generated image signal to a laser drive unit 202. The laser drive unit 202 controls the semiconductor laser 105 to be turned ON (light-up) or OFF (light-out) based on the image signal.

The CPU 201 reads out the light amount correction data (which will be described in detail later) stored in a memory 203, which serves as a storage unit, and transmits the read data to the laser drive unit 202. The laser drive unit 202 controls (corrects) the light amount (exposure intensity) of the laser light when the laser drive unit 202 turns on the semiconductor laser 105, based on the light amount correction data. The photosensitive drum 104 is driven to rotate by a drive motor 204 which serves as a drive unit.

The laser light emitted from the semiconductor laser 105 is reflected by the mirror surface of the polygon mirror 106 rotating at a constant speed (under the constant speed control). A beam detector 205 (hereinafter referred to as "BD 205") is disposed on a scanning line caused to scan by the polygon mirror 106. The image forming apparatus 100 according to the present exemplary embodiment further includes a crystal oscillator 207 (reference clock generation unit) which generates a reference clock, and the reference clock is input to the CPU 201.

The BD 205 is an optical sensor which generates a main scanning synchronization signal (hereinafter referred to as "BD signal") for adjusting an image writing start position in a main scanning direction (the direction of the rotational axis of the photosensitive drum 104). The BD signal is input into the CPU 201. The CPU 201 starts counting of the reference clock by an internal counter in response to an input of the BD signal, and outputs an enable signal for allowing the laser drive unit 202 to emit the laser light when the count value reaches a predetermined value. Further, the CPU 201 reads out the light amount correction data from the memory 230 according to the count value, and transmits the read data to the laser drive unit 202.

As illustrated in FIG. 2, the image forming apparatus according to the present exemplary embodiment includes the rotation reference position sensor 206 for detecting the reference position of the photosensitive drum 104. The rotation reference position sensor 206 is an optical sensor for detecting a mark provided on the photosensitive drum 104. The rotation reference position sensor 206 includes a light emission unit which irradiates light to an object (the photosensitive drum 104 or marks which will be described below), and a light reception unit for detecting reflective light of the light emitted from the light emission unit which is reflected by the object. The light reception unit detects diffused reflection light from the object (diffused reflection light detection sensor). The rotation reference position sensor 206 may be embodied by a specular reflection light detection sensor.

Figure 3A:
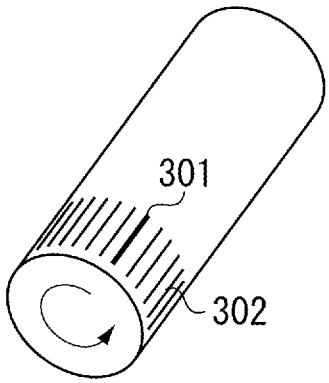
FIGS. 3A and 3B illustrate a photosensitive drum used in the image forming apparatus according to the first exemplary embodiment.
Figure 3B:
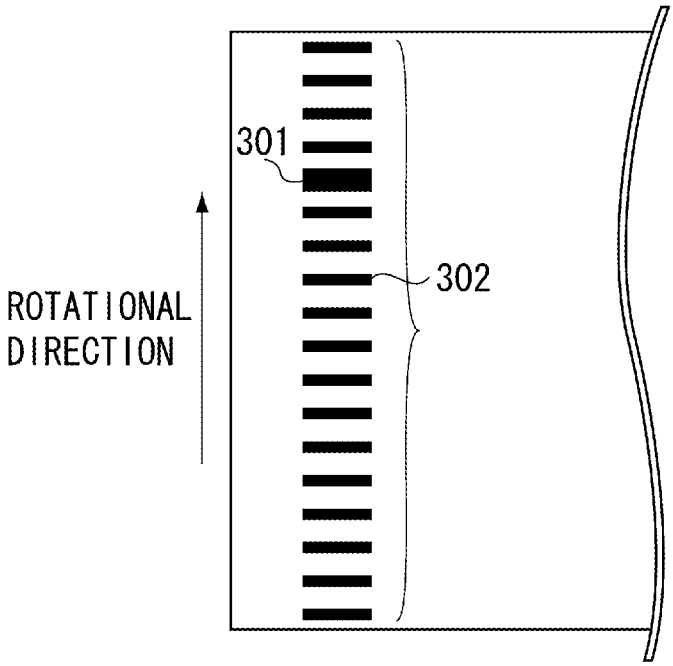

The mark will be described in detail with reference to FIGS. 3A and 3B. As illustrated in FIG. 3A, marks are provided on an end portion of the photosensitive drum 104 in the rotational axial direction on the same plane as the exposure surface of the photosensitive drum 104. These marks are constituted by a mark 301 (first mark) indicating the reference position of the photosensitive drum 104, and a plurality of marks 302 (second mark). FIG. 3B is an enlarged view of FIG. 3A. The plurality of marks 302 are provided in the rotational direction of the photosensitive drum 104, and are arranged to be equally spaced from respective adjacent marks 302 except for the portion where the mark 301 is provided.

The rotation reference position sensor 206 outputs a detection signal (first detection signal) having a pulse width according to a width of the mark 301 when the mark 301 passes through the detection position. Further, the rotation reference position sensor 206 outputs a detection signal (second detection signal) having a pulse width according to a width of the mark 302 when the mark 302 passes through the detection position.

Figure 4A:
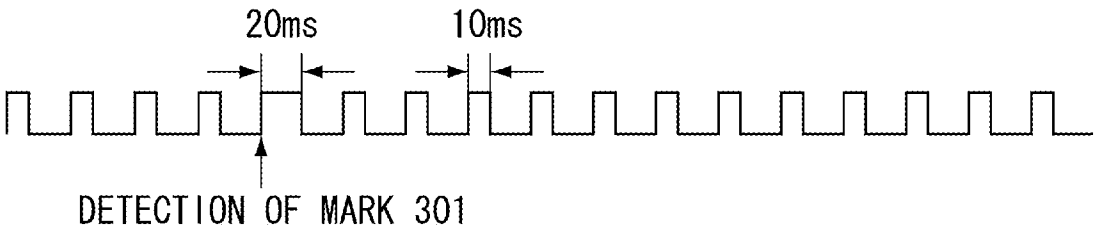
FIGS. 4A and 4B are timing charts illustrating detection signals output by a rotation reference position sensor.

The mark 301 and the mark 302 have different widths in the rotation direction of the photosensitive drum 104. Therefore, as illustrated in FIG. 4A, the width of the pulse output from the rotation reference position sensor 206 is different between detection of the mark 301 and detection of the mark 302. This difference in the width enables the CPU 201 to determine whether a detection signal output from the rotation reference position sensor 206 is a signal corresponding to the mark 301 or a signal corresponding to the mark 302.

In the present exemplary embodiment, the width of each mark 302 is half the width of the mark 301, and is narrower than the width of the mark 301. As illustrated in FIG. 4A, when the mark 301 is detected during the constant speed rotation of the photosensitive drum 104, the High level of the signal has a width of 20 ms. When the mark 302 is detected during the constant speed rotation of the photosensitive drum 104, the High level of the signal has a width of 10 ms.

Figure 4B:
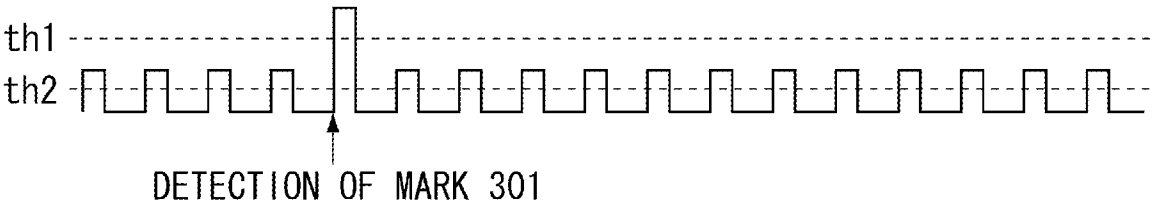

In this way, the resolution in the rotational direction of the photosensitive drum 104 for locating an exposure position can be improved by setting the width of the marks 302 to be narrower than the width of the mark 301. The improvement of the resolution enables a light amount correction to be applied to a narrower region. Alternatively, the marks 301 and 302 may have a substantially same width. In this case, the marks 301 and 302 may have different reflectances so that detection signals generated from the respective marks 301 and 302 can be differentiated based on the reflected light amount (output level of the detection signal) as illustrated in FIG. 4B.

In this case, the CPU 201 may determine that a detection signal exceeding a threshold value th1 is a signal corresponding to the mark 301, and a detection signal equal to or larger than a threshold value th2 and equal to or smaller than the threshold value th1 is a signal corresponding to the mark 302. Alternatively, the CPU 201 may determine that a detection signal exceeding the threshold value th1 is a signal corresponding to the mark 302, and a detection signal equal to or larger than the threshold value th2 and equal to or smaller than the threshold value th1 is a signal corresponding to the mark 301.

The rotation reference position sensor 206 in the present exemplary embodiment is a sensor for detecting diffused reflection light, and therefore the light amount of reflected light from the surface of the photosensitive member, which is more glossy than the marks 301 and 302, is smaller than the light amount of the reflected light from the marks 301 and 302 (refer to FIG. 4). These signals are input into the CPU 201 as illustrated in FIG. 2.

A pulse width of a signal output from the rotation reference position sensor 206 varies depending on the rotational speed of the photosensitive drum 104. More specifically, if marks having a same width provided on the photosensitive drum 104 are detected and the pulse width when the photosensitive drum 104 rotates at a first speed is compared with the pulse width when the photosensitive drum 104 rotates at a second speed higher than the first speed, the pulse width detected under the first speed is wider than the pulse width detected under the second speed.

Therefore, when the photosensitive drum 104 is under the variable speed control such as acceleration control and deceleration control, the CPU 201 cannot determine whether a signal output from the rotation reference position sensor 206 is a signal corresponding to the mark 301 or a signal corresponding to mark 302. Therefore, as illustrated in FIG. 2, a speed detection signal (for example, a Frequency Generator (FG) signal) for detecting the rotational speed of the photosensitive drum 104 is input from the drive motor 204 into the CPU 201.

The memory 203 stores a table including data about the pulse width corresponding to the mark 301 and data about the pulse width corresponding to the mark 302 in such a manner that the data is associated with each of a plurality of rotational speeds of the photosensitive drum 104. The CPU 201 recognizes the pulse width corresponding to the mark 301 and the pulse width corresponding to the mark 302 with respect to the present rotational speed based on the table, and determines whether a signal output from the rotation reference position sensor 206 is a signal corresponding to the mark 301 or a signal corresponding to the mark 302.

Further, the CPU 201 controls the rotational speed of the photosensitive drum 104 based on a speed detection signal from the drive motor 204. For example, if the frequency of a speed detection signal is lower than a predetermined frequency, this means that the rotational speed of the photosensitive drum 104 is lower than a predetermined speed (the speed under the constant speed control during image formation), and therefore the CPU 201 outputs an acceleration signal to the drive motor 204.

On the other hand, if the frequency of a speed detection signal is higher than the predetermined frequency, this means that the rotational speed of the photosensitive drum 104 is higher than the predetermined speed (the speed under the constant speed control during image formation), and therefore the CPU 201 outputs a deceleration signal to the drive motor 204. If the frequency of a speed detection signal remains equal to the predetermined frequency for a predetermined time, the CPU 201 determines that a state ready for image formation is established.

As illustrated in FIG. 2, the CPU 201 adds "1" to a count value (the number of detection signal outputs) of an internal counter (counting unit) in response to an input of a signal corresponding to the mark 302. Further, the CPU 201 resets the count value (set the count value to zero) in response to an input of a signal corresponding to the mark 301. Therefore, when the mark 301 is detected, the count value is set to zero. Then, the count value is incremented by 1 each time the equally spaced mark 302 is detected. When the photosensitive drum 104 finishes one rotation and the mark 301 is detected again, then the count value is returned to zero.

Figure 5A:
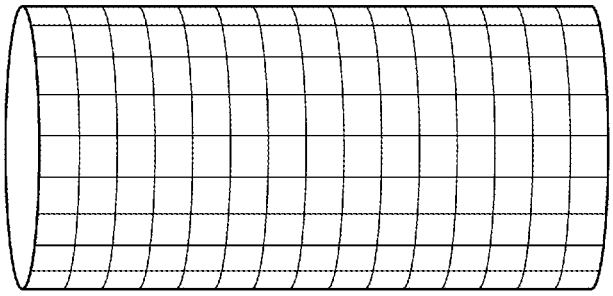
FIGS. 5A and 5B illustrate a surface of the photosensitive drum divided into a plurality of sections.
Figure 5B:
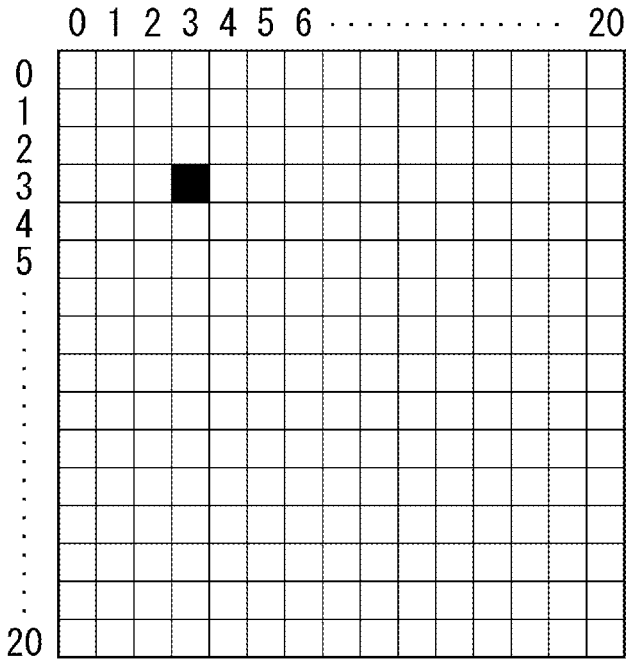

The memory 203 stores the light amount correction data associated with the count value. In other words, the memory 203 stores the light amount correction data associated with a plurality of sections on the surface of the photosensitive drum 104. For example, FIG. 5A illustrates the photosensitive drum 104, and FIG. 5B is a development view of the photosensitive drum 104. The marks 301 and 302 are omitted from FIGS. 5A and 5B. As illustrated in FIG. 5B, the surface of the photosensitive drum 104 is divided into sections arranged in a grid-like structure, and the light amount correction data is assigned to each section. The light amount correction data is prepared by measuring the potential change characteristic of each individual photosensitive drum 104 and generating the data based on the measurement result at the time of shipment from the factory.

The CPU 201 locates an exposure position in the rotational direction of the photosensitive drum 104 from the count value corresponding to the mark 302. The CPU 201 further locates the exposure position in the rotational axial direction from the count value which is counted from when a BD signal is input. For example, assuming that the numbers illustrated in FIG. 5B indicate the count values, if the count value in the rotational axial direction is "3" and the count value in the rotational direction is "3", this means that a blacked section in FIG. 5B is exposed to light. The CPU 201 reads out the light amount correction data corresponding to the blacked section from the memory 203, and outputs the read data to the laser drive unit 202.

The count value is reset or incremented during the acceleration control, the deceleration control, and the constant speed control. The counting is continued during image formation, and the CPU 201 constantly locates an exposure position to read out the light amount correction data from the memory 203. Accordingly, the CPU 201 can locate the exposure position at the moment that the rotation speed control of the photosensitive drum 104 is switched from the variable speed control to the constant speed control, and image formation can be started even before the rotation reference position sensor 206 detects the mark 301.

Figure 6:
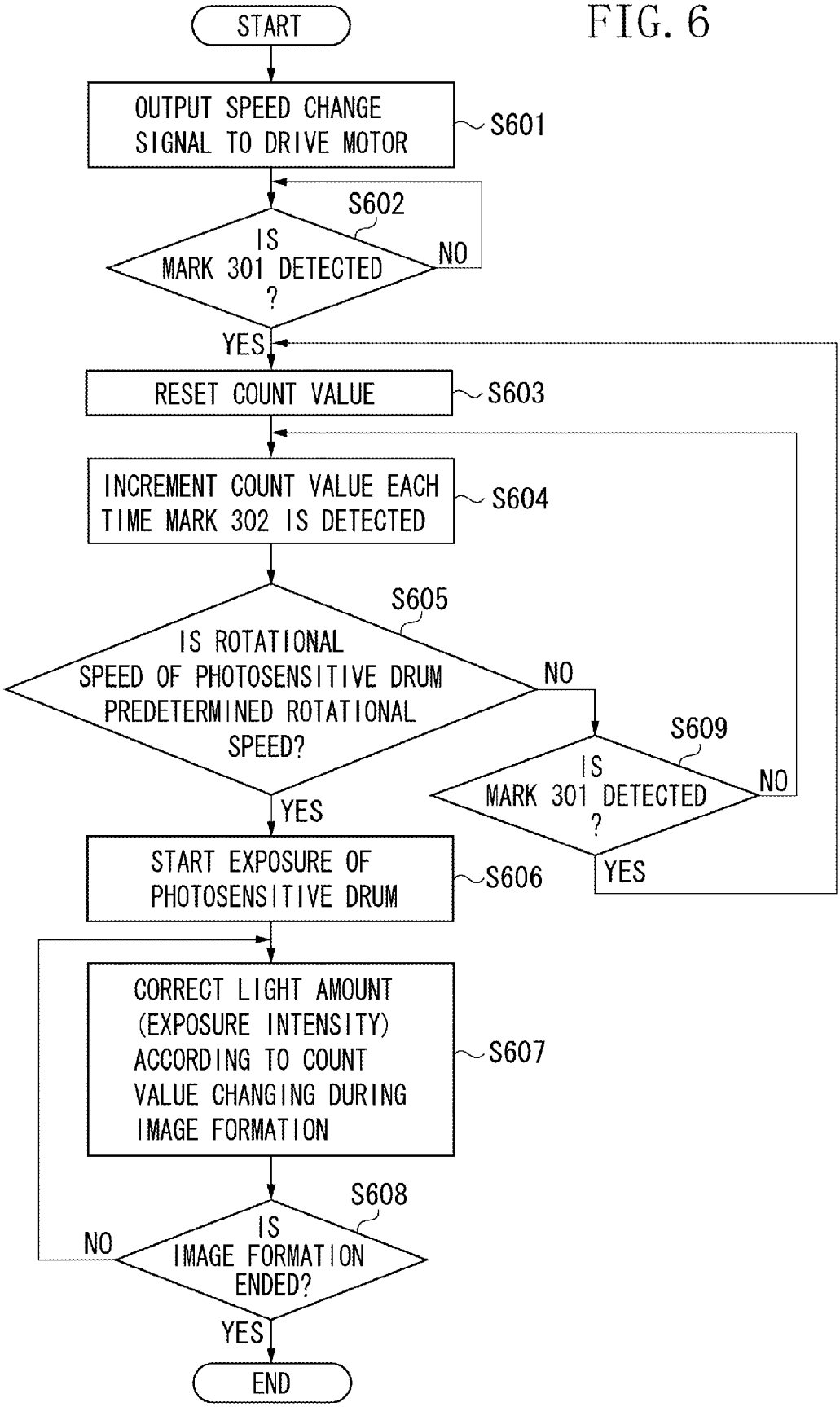
FIG. 6 is a flow chart illustrating control processing performed by a central processing unit (CPU) according to the first exemplary embodiment.

In the following, a control flow executed by the CPU 201 will be described with reference to FIG. 6. In step S601, when image data is input from the image reading unit 101 or an external apparatus, the CPU 201 outputs a speed change signal such as an acceleration signal or a deceleration signal to the drive motor 204 which drives the photosensitive drum 104. Accordingly, the photosensitive drum 104 goes into a state under the acceleration control or the deceleration control.

Then, in step S602, while the photosensitive drum 104 is under the acceleration control or the deceleration control, the CPU 201 determines whether a detection signal corresponding to the mark 301 is input from the rotation reference position sensor 206. If the CPU 201 determines in step S602 that the detection signal corresponding to the mark 301 is input (YES in step S602), the processing proceeds to step S603. In step S603, the CPU 201 resets the count value of the counter. Then, in step S604, the CPU 201 increments the count value in response to an input of a detection signal corresponding to the mark 302. On the other hand, if the CPU 201 determines in step S602 that the detection signal corresponding to the mark 301 is not input (NO in step S602), then the CPU 201 repeats the processing in step S602 until the detection signal corresponding to the mark 301 is input.

Then in step S605, the CPU 201 determines whether the rotational speed of the photosensitive drum 104 is a predetermined rotational speed. If the CPU 201 determines in step S605 that the rotational speed of the photosensitive drum 104 is the predetermined rotational speed (YES in step S605), the processing proceeds to step S606. In step S606, the CPU 201 transmits a signal for allowing exposure to the laser drive unit 202 (starts exposure of the photosensitive drum 104).

In step S607, in response to the start of exposure, the CPU 201 reads out, from the memory 203, the light amount correction data corresponding to the count value varying during the image formation, and controls the light amount based on the light amount correction data. Then, in step S608, the CPU 201 determines whether the image formation is finished. If the image formation is not finished (NO in step S608), the control returns the processing to step S607. Whereas if the image formation is finished (YES in step S608), the control is ended.

On the other hand, if the CPU 201 determines in step S605 that the rotational speed of the photosensitive drum 104 is not the predetermined rotational speed (NO in step S605), then the processing proceeds to step S609. In step S609, the CPU 201 determines whether a signal corresponding to the mark 301 is input from the rotation reference position sensor 206 (whether the mark 301 is detected). If the CPU 201 determines in step S609 that the mark 301 is detected (YES in step S609), the processing returns to step S603. If the CPU 201 determines that the mark 301 is not detected (NO in step S609), the processing returns to step S604.

As described above, by providing the marks 301 and 302 at the end of the photosensitive drum 104, the light amount to correct sensitivity unevenness of the photosensitive drum 104 can be accurately corrected if the rotational speed of the photosensitive drum 104 is changed. Further, the light amount to correct sensitivity unevenness of the photosensitive drum 104 can be corrected based on an output from one sensor (the rotation reference position sensor 206).

The first exemplary embodiment has been described based on an example of the electrophotographic image forming apparatus using the polygon mirror 106. A second exemplary embodiment will be described based on an example of an image forming apparatus in which light sources of the number equal to the number of pixels in the main scanning direction are provided in the rotational direction of the photosensitive drum 104, and an electrostatic latent image is formed on the photosensitive drum 104 without using a polygon mirror. The units that serve the same functions as those of the first exemplary embodiment will be denoted by the same reference numerals for simplification of the description.

Figure 7:
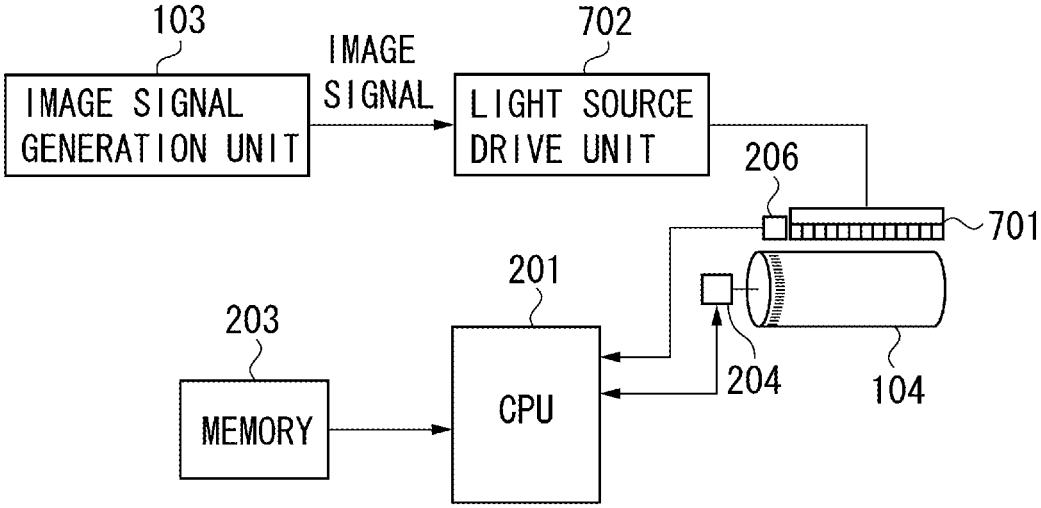
FIG. 7 is a control block diagram according to another exemplary embodiment.

As illustrated in FIG. 7, a light source 701 (for example, a light emitting diode (LED) array) configured into an array along the rotational axial direction is disposed in the vicinity of the photosensitive drum 104. The light source 701 includes light emitting elements of the number corresponding to at least the resolution (the number of pixels) formed by the image forming apparatus. Each of the light emitting elements can emit light of individual light amount through control of drive current supplied from a light source drive unit 702.

The memory 203 stores the light amount correction data for controlling the light emitting amount of each light emitting element. The CPU 201 reads out the light amount correction data from the memory 203 based on an exposure position, and controls the drive current supplied to each light emitting element based on the light amount correction data.

As described above, in the image forming apparatus capable of forming an image without using a polygon mirror, the light amount to correct sensitivity unevenness of the photosensitive drum 104 can be accurately corrected by providing the marks 301 and 302 at the end of the photosensitive drum 104, if the rotational speed of the photosensitive drum 104 is changed. Further, the light amount to correct sensitivity unevenness of the photosensitive drum 104 can be corrected based on an output from one sensor.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-095272 filed Apr. 16, 2010, which is hereby incorporated by reference herein in its entirety.

What is claimed is:

1. An image forming apparatus comprising:

a photosensitive member configured to be driven to rotate by a drive unit, wherein the photosensitive member includes a first mark and a plurality of second marks whose shape is different from a shape of the first mark, and the first mark and the plurality of second marks are disposed along the rotational direction of the photosensitive member;

an exposure unit configured to expose the photosensitive member;

a detection unit configured to detect the first mark and the plurality of second marks;

an output unit configured to output correction data corresponding to the first mark and each of the plurality of second marks detected by the detection unit;

a control unit configured to control an exposure intensity of the exposure unit based on the correction data output by the output unit, wherein the output unit is a storage unit configured to store correction data corresponding to the first mark and each of the plurality of second marks, and the storage unit outputs correction data corresponding to the first mark based on detection of the first mark by the detection unit and correction data corresponding to any one of the plurality of the second marks detected by the detection unit based on detection of any one of the plurality of the second marks detected by the detection unit; and a counting unit configured to reset a count value if the detection unit detects the first mark, and count the number of the detection signal which is output from the detection unit in accordance with detecting the second mark after the detection of the first mark, wherein the correction data corresponding to the plurality of second marks is correction data corresponding to the count value counted by the counting unit, and wherein the control unit controls the exposure intensity according to the correction data based on the count value of the counting unit.

2. The image forming apparatus according to claim 1, wherein the first mark and the second marks have different widths in the rotational direction.

3. The image forming apparatus according to claim 2, wherein the width of the first mark in the rotational direction is wider than the width of the second marks in the rotational direction.

4. The image forming apparatus according to claim 1, wherein the exposure unit includes a light source configured to emit a light beam to which the photosensitive member is exposed, and a scanning unit configured to deflect the light beam so that the light beam moves on the photosensitive member in a predetermined direction, wherein the image forming apparatus includes a light receiving unit configured to output a synchronization signal in response to that the light receiving unit receives the light beam deflected by the scanning unit, and a reference clock generation unit configured to generate a reference clock, wherein the correction data is correction data corresponding to each of a plurality of sections on the photosensitive member in a predetermined direction, and wherein the counting unit starts counting of the reference clock in response to generation of the synchronization signal, and the control unit controls the exposure intensity according to the correction data based on the count value obtained from the counting and the count value of the detection signal.

5. The image forming apparatus according to claim 1, wherein the counting unit counts the number of the detection signal outputs which is output from the detection unit when the second mark is detected while a rotational speed of the photosensitive member is under a variable speed control by the drive unit, and the control unit controls the exposure intensity when the control of the rotational speed of the photosensitive member is switched from the variable speed control to a constant speed control, according to the count value of the counting unit when the control of the rotational speed of the photosensitive member is switched from the variable speed control to the constant speed control.

6. An image forming apparatus comprising:

a photosensitive member configured to be driven to rotate by a drive unit, wherein the photosensitive member includes a first mark and a plurality of second marks having a different light reflectance from a light reflectance of the first mark, and the first mark and the plurality of second marks are disposed along the rotational direction of the photosensitive member;

an exposure unit configured to expose the photosensitive member;

a detection unit configured to irradiate light to each of the plurality of second marks or the first mark, and output a detection signal according to a light amount of reflected light from each of the plurality of second marks or the first mark;

an output unit configured to output correction data corresponding to the first mark and each of the plurality of second marks detected by the detection unit;

a control unit configured to control an exposure intensity of the exposure unit based on the correction data output by the output unit, wherein the output unit is a storage unit configured to store correction data corresponding to the first mark and each of the plurality of second marks, and the storage unit outputs correction data corresponding to the first mark based on detection of the first mark by the detection unit and correction data corresponding to any one of the plurality of the second marks detected by the detection unit based on detection of any one of the plurality of the second marks detected by the detection unit; and a counting unit configured to reset a count value if the detection unit outputs the detection signal corresponding to the first mark, and count the number of the detection signal outputs which is output when the second mark is detected after the detection of the first mark, wherein the correction data corresponding to the plurality of second marks is correction data corresponding to the count value counted by the counting unit, and wherein the control unit controls the exposure intensity according to the correction data based on the count value of the counting unit.

7. The image forming apparatus according to claim 6, wherein the counting unit counts the number of the detection signal outputs which is output when the second mark is detected while a rotational speed of the photosensitive member is under a variable speed control by the drive unit, and the control unit controls the exposure intensity when the control of the rotational speed of the photosensitive member is switched from the variable speed control to a constant speed control, according to the count value of the counting unit when the control of the rotational speed of the photosensitive member is switched from the variable speed control to the constant speed control.

8. The image forming apparatus according to claim 6, wherein the exposure unit includes a light source configured to emit a light beam to which the photosensitive member is exposed, and a scanning unit configured to deflect the light beam so that the light beam moves on the photosensitive member in a predetermined direction, wherein the image forming apparatus includes a light receiving unit configured to output a synchronization signal in response to that the light receiving unit receives the light beam deflected by the scanning unit, and a reference clock generation unit configured to generate a reference clock, wherein the correction data is correction data corresponding to each of a plurality of sections on the photosensitive member in a predetermined direction, and wherein the counting unit starts counting of the reference clock in response to generation of the synchronization signal, and the control unit controls the exposure intensity according to the correction data based on the count value obtained from the counting and the count value of the detection signal.

* * * * *